US005608183A

United States Patent [19]

Barnes et al.

[11] Patent Number: 5,608,183

[45] Date of Patent: Mar. 4, 1997

[54] GAS GENERANT COMPOSITIONS CONTAINING AMINE NITRATES PLUS BASIC COPPER (II) NITRATE AND/OR COBALT(III) TRIAMMINE TRINITRATE

[75] Inventors: Michael W. Barnes, Brigham City; Robert D. Taylor, Hyrum, both of Utah

[73] Assignee: Morton International, Inc., Chicago, Ill.

[21] Appl. No.: 616,408

[22] Filed: Mar. 15, 1996

[51] Int. Cl.[6] ..... C06B 31/00

[52] U.S. Cl. ..... 149/45; 149/36

[58] Field of Search ..... 149/36, 45

[56] References Cited

U.S. PATENT DOCUMENTS

| | | | |
|---|---|---|---|
| 2,220,891 | 11/1940 | Cook et al. | 149/2 |
| 4,369,079 | 1/1983 | Shaw . | |
| 4,370,181 | 1/1983 | Lundstrom et al. . | |
| 5,125,684 | 6/1992 | Cartwright | 280/736 |
| 5,160,386 | 11/1992 | Lund et al. | 149/45 |
| 5,197,758 | 3/1993 | Lund et al. . | |
| 5,198,046 | 3/1993 | Bucerius et al. | 149/36 |
| 5,386,775 | 2/1995 | Poole et al. | 149/36 |
| 5,429,691 | 7/1995 | Hinshaw et al. | 149/45 |
| 5,431,103 | 7/1995 | Hock et al. . | |
| 5,472,535 | 12/1995 | Mendenhall et al. | 149/36 |
| 5,516,377 | 5/1996 | Highsmith et al. | 149/36 |
| 5,542,704 | 8/1996 | Hamilton et al. | 149/36 |
| 5,542,998 | 8/1996 | Bucerius et al. | 149/45 |
| 5,542,999 | 8/1996 | Bucerius et al. | 149/45 |

FOREIGN PATENT DOCUMENTS 9509825 4/1995 WIPO .

*Primary Examiner*—Edward A. Miller

*Attorney, Agent, or Firm*—Wayne E. Nacker; Gerald K. White

[57] ABSTRACT

A gas generant composition comprises between about 30 and about 85 wt. % of A) fuel, and between about 15 and about 70 wt % of B) oxidizer based on total weight of A) plus B). At least about 60 wt %, up to 100 wt % of the fuel A) comprises an nitrate salt of a polyamine of the general formula selected from the group consisting of:

$$ZHN-CO-NHZ, \quad (I)$$

$$\begin{array}{c} Z-N-H \\ \| \\ ZHN-C-NHZ, \end{array} \quad (II)$$

$$ZHN-CO-NH-CO-NHZ, \quad (III)$$

wherein in formulae (I)–(III) the Zs are the same or different and are selected from H and $NH_2$, (IV) $C_2$–$C_3$-alkyl diamine, and mixtures thereof. At least about 60 wt %, up to 100 wt % of the oxidizer B) comprises basic copper(II) nitrate, i.e. $Cu(NO_3)_2.3Cu(OH)_2$ and/or cobalt(III)triammine trinitrate, i.e., $Co(NH_3)_3.(NO_3)_3$.

5 Claims, No Drawings

GAS GENERANT COMPOSITIONS CONTAINING AMINE NITRATES PLUS BASIC COPPER (II) NITRATE AND/OR COBALT(III) TRIAMMINE TRINITRATE

The present invention is directed to gas generant compositions, such as those used to inflate automotive airbags, and particularly to gas generant compositions using copper(II) nitrate complexes as fuel.

BACKGROUND OF THE INVENTION

Gas generant compositions for inflating automotive airbags are most commonly based on sodium azide, which, on inflation, produce nitrogen gas. However, due to toxicity and stability problems, there is a significant movement away from sodium azide as a fuel, and a number of non-azide gas generant formulations have been proposed, e.g., U.S. Pat. Nos. 4,369,079, 4,370,181, 5,197,758, and 5,431,103, the teachings of each of which are incorporated herein by reference. Non-azide formulations, however, tend to present their own problems, such as generation of particulates and generation of noxious gases. Thus, there remains a need for safe, effective gas generants for inflating automotive airbags and the like.

Patent document WO95/09825 teaches gas generant compositions using polyamine nitrates as fuel, an oxidizer which is an alkali or alkaline-earth nitrate or ammonium nitrate, plus a carrier substance for improving ash content. While these compositions described in this document have several advantageous properties, it would be desirable to provide compositions which burn at lower temperatures, an attribute particularly desirable in compositions used in inflator modules with aluminum housing or other aluminum components, and which provide higher gas yields.

SUMMARY OF THE INVENTION

In accordance with the present invention there is provided a gas generant composition comprising between about 30 and about 85 wt. % of A) fuel, and between about 15 and about 70 wt % of B) oxidizer based on total weight of A) plus B). At least about 60 wt %, up to 100 wt % of the fuel A) comprises an nitrate salt of a polyamine of the general formulae selected from the group consisting of:

$$ZHN-CO-NHZ, \quad (I)$$

$$\begin{array}{c} Z-N-H \\ \| \\ ZHN-C-NHZ, \end{array} \quad (II)$$

$$ZHN-CO-NH-CO-NHZ, \quad (III)$$

wherein in formulae (I)–(III) the Zs are the same or different and are selected from H and $NH_2$, (IV) $C_2$–$C_3$-alkyl diamine, and mixtures thereof. At least about 60 wt %, up to 100 wt % of the oxidizer B) comprises basic copper(II) nitrate, i.e., $Cu(NO_3)_2.3Cu(OH)_2$, cobalt(III)triammine trinitrate, i.e., $Co(NH_3)_3.(NO_3)_3$, or mixtures thereof.

DETAILED DESCRIPTION OF CERTAIN PREFERRED EMBODIMENTS

Unless otherwise noted, percentages are in weight percent. Components other than the oxidizer are calculated relative to the total weight of oxidizer plus fuel being 100 weight percent.

Some specific nitrate salts of polyamines useful as the primary fuel include nitrate salts of urea, guanidine, aminoguanidine, diaminoguanidine, and semicarbazide. Nitrate amines which are salts of amines according to formula (IV) include ethylene diamine, 1,3-propane diamine, and 1,2-propane diamine, ethylene diamine being the preferred amine of formula (IV). Because polyamines of formulae (I)–(IV) are only mildly basic, generally only a mono nitrate salt may be formed; however, where possible, a dinitrate or trinitrate salt is also acceptable. In burning, none of the nitrate salts of amines of formulae (I)–(IV) produce any solid material.

The use of basic copper(II) nitrate and/or cobalt(III)triammine trinitrate as the primary oxidizer provides a substantially higher gas yield than is obtained by compositions in accordance with above-identified patent document WO95/09825 because basic copper(II) nitrate itself yields gas when used in combustion. The only solid combustion product of basic copper(II) nitrate is copper(II) metal, an easily filterable material. The only combustion product of cobalt(III) triammine trinitrate is cobalt, likewise easily filterable. Thus, if the only fuel used is one or more of the nitrate salts of polyamines of formula (I)–(IV) and basic copper(II) nitrate and/or cobalt(III) triammine trinitrate is used as the only oxidizer, the only solid material produced is copper and/or cobalt metal.

While basic copper(II) nitrate and/or cobalt(III) triammine trinitrate is preferably used alone as the sole oxidizer, up to 40 wt % of the oxidizer may be another oxidizer, including those known in the art, such as alkali metal and alkaline earth metal nitrates, chlorates and perchlorates, as well as transition metal oxides, such as cupric oxide and iron oxide, and mixtures of such oxidizers.

In addition to the fuel A) and oxidizer B) components, the gas generant compositions of the present invention may further contain additional components, such as pressing aids, lubricants, coolants, etc., as is known in the art, up to about 10 wt % based on total weight of fuel A) plus oxidizer B) calculated as 100 wt %.

So that the gas generant compositions of the present invention burn at a sufficient mass flow rate, it is preferred that the gas generant compositions be provided in the form of particulates having a high surface area to volume ratio, i.e., particulates having a surface area to volume ratio of at least about 1 $mm^{-1}$, and preferably a surface area to volume ratio of at least about 5 $mm^{-1}$. High surface area may be achieved by forming small prills, e.g., about 3 mm in diameter or smaller, preferably about 2 mm in diameter or smaller. Such prills may be formed by a spheronization process, such as that taught in U.S. Pat. Nos. 4,994,212 and 5,084,218, the teachings of each of which are incorporated herein by reference.

The compositions of the present invention may also be formed by conventional extrusion in the form of chopped cylindrical rods or perforated chopped cylindrical rods. If extruded, it is preferred to add between about 2 and about 10 weight percent, preferably between about 3 and about 5 weight percent, of a binder.

Gas generant compositions in accordance with the invention have a number of advantages. The compositions have high gas yield and can be readily formulated to produce greater than 2.0 moles of gas per 100 grams of generant. Combustion temperatures are moderate, and compositions can be easily formulated to burn at about 2000° C. and below. The components are readily available, thermally stable, non-explosive, and non-toxic. They can be manufactured by low-cost, reproducible methods.

The invention will now be described in greater detail by way of specific examples.

EXAMPLE 1

Basic copper(II) nitrate (47.87 wt %) and guanidine nitrate (42.13 wt %) were added to enough water to provide a slurry of about 10 wt % water. The slurry was mixed in a Hobert® mixer and then extruded and spheronized using a Nica® extruder/spheronizer. The prills were dried on a fluid bed drier. By appropriate adjustment of water content and extrusion/spheronization conditions, prills 2 mm in diameter were obtained.

EXAMPLE 2

Basic copper(II)nitrate (58.9 wt %), guanidine nitrate (41.1 wt %), and guar gum (5.3 wt % calculated relative to fuel plus oxidizer) were mixed with enough water (about 10 wt %) to form a slurry. The slurry was extruded in a single screw Haake® extruder with an appropriate die to make long strands of pyrotechnic with a single perforation of 0.035 inch (0.86 mm) inside diameter and 0.06 (1.47 mm) inch outside diameter. The strands were chopped with an automated chopper to 0.1 (2.45 mm) inch lengths. 38 grams of the pellets were used in an airbag inflator. Internal combustion pressure was 2500 psi and 60 liter tank pressure was about 250 kPA. Both are considered acceptable.

EXAMPLE 3

Typical non-azide gas generant formulations found in the patent literature are compared in the table below with respect to gas yield (moles per 100 grams), combustion temperature ($T_c$) in degrees Kelvin, and filterability of the solid combustion products.

| PATENT | COMPOSITION (wt. %) | GAS YIELD (M/100 gm) | $T_c$ (degK) | FILTERABILITY |
|---|---|---|---|---|
| U.S. Pat. No. 4,369,079 | $K_2BT/KNO_3$ (45.5/54.5) | 1.3 | 2381 | Poor |
| U.S. Pat. No. 5,139,588 | $Sr(NO_3)_2/AT/SiO_2$ (58.9/33.1/8) | 2.3 | 2571 | ok |
| U.S. Pat. No. 5,197,758 | $Zn(AT)_2/Sr(NO_3)_2$ (44/56) | 1.93 | 1856 | Poor |
| U.S. Pat. No. 4,993,112 | $NTO/Sr(NO_3)_2$ (38.1/68.9) | 2.5 | 2844 | Poor |
| U.S. Pat. No. 5,467,715 | $AT/CuO/GuNO_3$ & $Sr(NO_3)_2$ (20/69/6/5) | 1.5 | 1550 | Good |
| WO95/09825 | $TAGN/KNO_3/SiO_2$ (47.3/40.7/12.0) | 2.75 | 2468 | Fair |
| This invention | $bCN/GuNO_3$ (47.87/52.13) | 2.9 | 1760 | Good |
| This invention | bCN/urea nitrate (17.82/82.18) | 3.45 | 1955 | Good |
| This invention | $CoTTN/GuNO_3$ (58.1141.9) | 3.7 | 1888 | Good |

$K_2BT$ = potassium salt of bitetrazole; AT = 5-aminotetrazole; $Zn(AT)_2$ = zinc salt of 5-aminotetrazole; NTO = nitrazolone; $GuNO_3$ = guanidine nitrate; bCN = basic copper nitrate; CoTTN = cobalt(III)triammine trinitrate, TAGN = triamino gunidinium nitrate Of the above-compared gas generants, the generants of the present invention are preferred, producing high gas volume, low combustion temperature (highly desirable in aluminum inflators or inflators with aluminum parts, and good filterability.

What is claimed is:

1. A gas generant composition comprising between about 30 and about 85 wt. % of A) a fuel, and between about 15 and about 70 wt % of B) oxidizer based on total weight of A) plus B), at least about 60 wt %, up to 100 wt % of said fuel A) comprising an nitrate salt of a polyamine of the general formulae selected from the group consisting of:

$$ZHN-CO-NHZ, \quad (I)$$

$$\begin{array}{c} Z-N-H \\ \| \\ ZHN-C-NHZ, \end{array} \quad (II)$$

$$ZHN-CO-NH-CO-NHZ, \quad (III)$$

wherein in formulae (I)–(III) the Zs are the same or different and are selected from H and $NH_2$, balance of A) other fuel, (IV) $C_2$–$C_3$-alkyl diamine, and mixtures thereof, at least about 60 wt %, up to 100 wt % of said oxidizer B) being selected from the group consisting of $Cu(NO_3)_2.3Cu(OH)_2$, $Co(NH_3)_3.(NO_2)_3$ and mixtures thereof, balance of B) other oxidizer.

2. A composition in accordance with claim 1 in particulate form, the particulates having surface area to volume ratios of at least about 1 $mm^{-1}$.

3. A composition in accordance with claim 1 in particulate form, the particulates having surface area to volume ratios of at least about 5 $mm^{-1}$.

4. A composition in accordance with claim 1 wherein said oxidizer is $Cu(NO_3)_2.3Cu(OH)_2$.

5. A composition in accordance with claim 1 wherein said oxidizer is $Co(NH_3)_3.(NO_2)_3$.

* * * * *